US010199750B2

(12) United States Patent
Endo et al.

(10) Patent No.: US 10,199,750 B2
(45) Date of Patent: Feb. 5, 2019

(54) PRESS-FIT TERMINAL

(71) Applicant: Dai-ichi Seiko Co., Ltd., Kyoto-shi, Kyoto (JP)

(72) Inventors: Takayoshi Endo, Shizuoka (JP); Sakai Yagi, Shizuoka (JP); Takuya Takeda, Shizuoka (JP)

(73) Assignee: DAI-ICHI SEIKO CO., LTD., Kyoto-Shi, Kyoto (JP)

( * ) Notice: Subject to any disclaimer, the term of this patent is extended or adjusted under 35 U.S.C. 154(b) by 108 days.

(21) Appl. No.: 15/379,082

(22) Filed: Dec. 14, 2016

(65) Prior Publication Data

US 2017/0179623 A1 Jun. 22, 2017

(30) Foreign Application Priority Data

Dec. 22, 2015 (JP) ..... 2015-250076

(51) Int. Cl.

| | |
|---|---|
| ***H01R 12/91*** | (2011.01) |
| ***H01R 4/48*** | (2006.01) |
| ***H01R 4/18*** | (2006.01) |
| ***H01R 12/58*** | (2011.01) |
| ***H01R 13/17*** | (2006.01) |

(52) U.S. Cl.

CPC ..... *H01R 4/48* (2013.01); *H01R 4/183* (2013.01); *H01R 12/585* (2013.01); *H01R 13/17* (2013.01)

(58) Field of Classification Search

CPC ... H01R 13/6315; H01R 12/91; H01R 13/052
USPC ..... 439/246, 825
See application file for complete search history.

(56) References Cited

U.S. PATENT DOCUMENTS

2005/0037650 A1* 2/2005 Hsu ..... H01R 13/112 439/246
2013/0244506 A1* 9/2013 Endo ..... H01R 4/48 439/825
2013/0244512 A1* 9/2013 Endo ..... H01R 12/585 439/889
2014/0017914 A1* 1/2014 Endo ..... H01R 12/7082 439/81
2015/0011114 A1* 1/2015 Endo ..... H01R 13/58 439/449

(Continued)

FOREIGN PATENT DOCUMENTS

EP 2 639 887 A1 9/2013
EP 2 685 566 A2 1/2014

(Continued)

OTHER PUBLICATIONS

European Search Report (Appln. No. 16204755.9); dated Feb. 28, 2017.

(Continued)

*Primary Examiner* — Gary Paumen
(74) *Attorney, Agent, or Firm* — Howard & Howard Attorneys PLLC

(57) ABSTRACT

A press-fit terminal comprises a contact member making contact with an electrode of a through-hole via penetrating a circuit substrate. The contact member comprises multiple contact pieces making contact with the electrode of the through-hole via, a junction part supporting the multiple contact pieces together, and a fixing part fixed to a main piece of a pin part and supporting the junction part via a flexible part.

4 Claims, 11 Drawing Sheets

(56) References Cited

U.S. PATENT DOCUMENTS

2015/0079851 A1* 3/2015 Endo ..... H01R 12/585
439/736

FOREIGN PATENT DOCUMENTS

| | | | |
|---|---|---|---|
| EP | 2 849 290 | A1 | 3/2015 |
| JP | 2009-021016 | A | 1/2009 |
| JP | 2013-196864 | A | 9/2013 |
| JP | 2016-110758 | A | 6/2016 |

OTHER PUBLICATIONS

Office Action (KR Patent Appln. No. 2016-0174324); dated Feb. 27, 2018.

* cited by examiner

PRESS-FIT TERMINAL

CROSS-REFERENCE TO RELATED APPLICATION

This application claims the benefit of Japanese Patent Application No. 2015-250076, filed on Dec. 22, 2015, the entire disclosure of which is incorporated by reference herein.

TECHNICAL FIELD

This application relates generally to a press-fit terminal.

BACKGROUND ART

Press-fit terminals inserted into through-holes formed in a circuit substrate are proposed (for example, see Patent Literature 1). A press-fit terminal comprises a bar-like terminal body and multiple contact pieces extending from the tip of the terminal body in the lateral direction of the terminal body and making contact with the electrode within a through-hole while inserted in the through-hole.

Unexamined Japanese Patent Application Kokai Publication No. 2009-021016.

SUMMARY OF INVENTION

In the process of manufacturing a product comprising a circuit substrate, the circuit substrate may be dislocated while press-fit terminals are connected to the circuit substrate. When the circuit substrate is dislocated, the press-fit terminals are inserted with the center axis of their terminal body misaligned with the center axis of the through-hole. In such a case, the press-fit terminal described in the Patent Literature 1 causes the contact pressure applied to the inner periphery of the through-hole from the contact pieces to be biased in the direction of misalignment of the center axis. Where the contact pressure is lower, a gap occurs between the inner periphery of the through-hole and the contact piece and the resistance between the inner periphery of the through-hole and the contact piece increases, whereby defective electric connection can easily occur.

The present disclosure is made with the view of the above reason and an objective of the disclosure is to provide a press-fit terminal unlikely to cause defective electric connection.

In order to achieve the above objective, the press-fit terminal according to the present disclosure is a press-fit terminal comprising a contact member making contact with an electrode, wherein the contact member comprises:

multiple contact pieces making contact with the electrode;

a junction part supporting the multiple contact pieces together; and a fixing part fixed to a pin part and supporting the junction part via a flexible part.

According to the present disclosure, the flexible part bends, whereby the multiple contact pieces and junction part are altogether tilted about the fixing part. As a result, for example, when the press-fit terminal is inserted in a through-hole via of a circuit substrate with the center axis misaligned with the center axis of the pin part, the flexible part bends and the multiple contact pieces are altogether tilted in the direction to cancel the misalignment, thereby making even the pressing force of multiple contact pieces on the electrode provided on the inner periphery of the through-hole via.

Hence, a gap is unlikely to occur between the press-fit terminal and through-hole via and thus defective electric connection is unlikely to occur.

BRIEF DESCRIPTION OF THE DRAWINGS

A more complete understanding of this application can be obtained when the following detailed description is considered in conjunction with the following drawings, in which.

DETAILED DESCRIPTION

Figure 1:
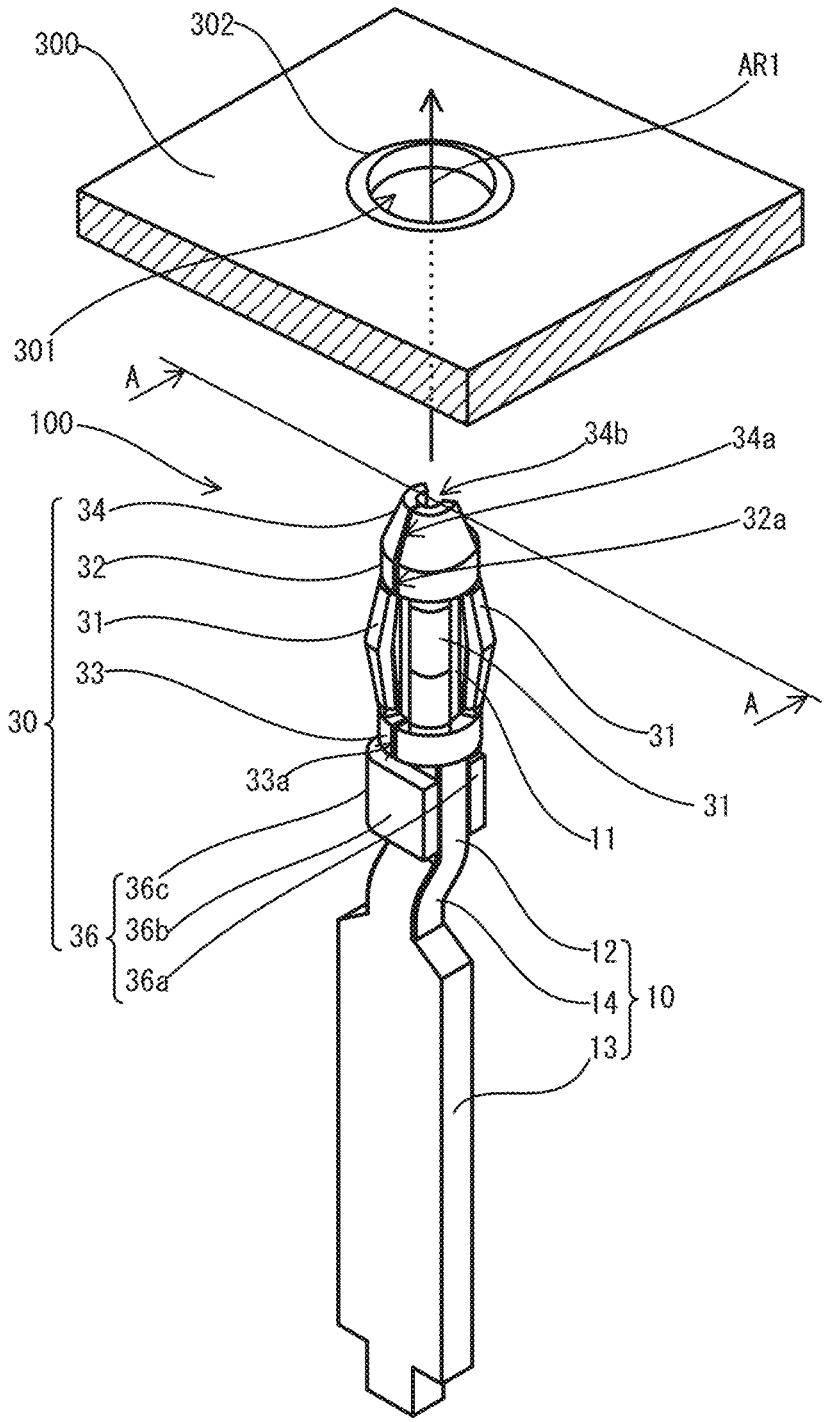
FIG. 1 is a perspective view showing the press-fit terminal according to an embodiment of the present disclosure and a circuit substrate.

An embodiment of the press-fit terminal according to an embodiment of the present disclosure will be described hereafter with reference to the attached drawings. The press-fit terminal according to this embodiment allows a large current of approximately 60 to 80 A to flow through and is integrated with a pin part functioning as an external connection terminal of a terminal module (not shown). As shown in FIG. 1, a press-fit terminal 100 comprises a terminal body 11 and a contact member 30. The terminal body 11 is integrated with a long pin part 10 at one end in the longitudinal direction of the pin part 10.

The pin part 10 has a main piece 12 in the shape of an elongated plate, a wide piece 13 in the shape of an elongated place larger in width than the main piece 12, and a connection piece 14 interposed between the main piece 12 and wide piece 13. The connection piece 14 is bent into an S-letter shape. For example, a metal wire is bonded to the opposite end of the wide piece 13 to the connection piece 14.

Figure 2:
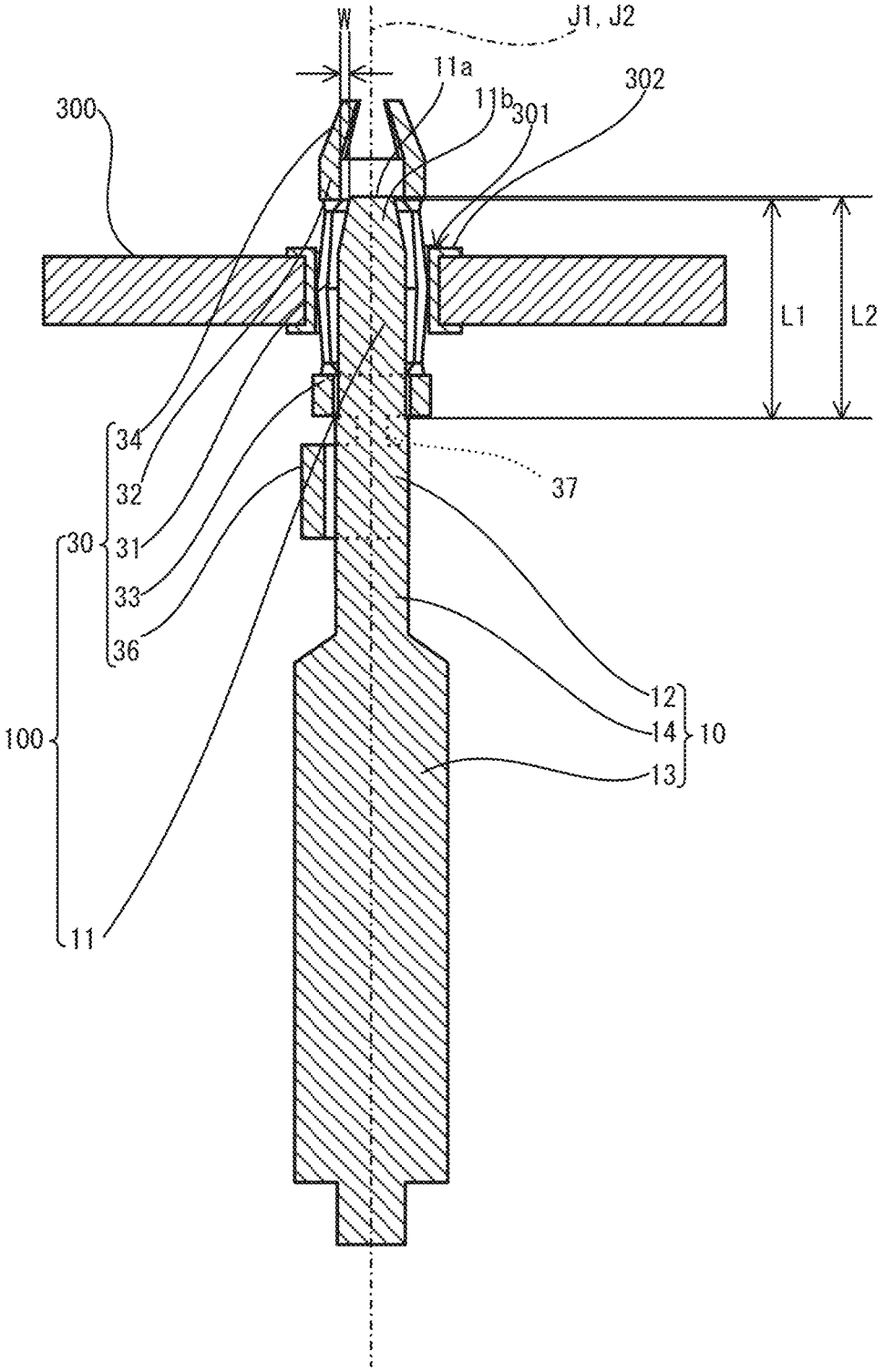
FIG. 2 is a cross-sectional view at the line A-A in FIG. 1 of the press-fit terminal according to the embodiment when seen in the arrowed direction.

The terminal body 11 is in the shape of a column as shown in FIG. 2. Moreover, the terminal body 11 is disposed with its center axis J1 coinciding with the center axis of the pin part 10. The terminal body 11 has a leading end 11*b* in the shape of a truncated cone. The terminal body 11 and pin part 10 are made of a metal such as copper and aluminum and preferably a metal having an electric conductivity of 99.9% IACS or higher.

The contact member 30 (press-fit member) comprises, as shown in FIG. 1, multiple contact pieces 31, junction parts 32 and 33, a head 34, and a fixing part 36. The contact member 30 is made of a metal more resilient than the material of the pin part 10 and terminal body 11. The contact member 30 is formed by punching and bending a sheet of metal.

The multiple contact pieces 31 are each in the shape of an elongated plate. The contact pieces 31 each extend in the direction of the center axis J1 and are arranged overall at equal intervals in the circumferential direction. Moreover, the contact pieces 31 are bent at a blunt angle in the center in the longitudinal direction. The contact pieces 31 are each disposed to be more away from the terminal body 11 in the center than at the ends in the longitudinal direction.

The junction part 33 supports the multiple contact pieces 31 at one end and maintains the relative positions of the contact pieces 31. Moreover, the junction part 32 supports the multiple contact pieces 31 at the other end. Then, the junction parts 32 and 33 maintain the multiple contact pieces 31 overall in a spindle shape. The junction parts 32 and 33 are in the shape of a letter C, namely in the shape of a cylinder with a cutout 32*a* or 33*a* in a portion in the circumferential direction, and surround the terminal body 11. The junction part 32 is formed so that at least a gap having a width W is formed between its inner periphery and the leading end 11*b* of the terminal body 11 as shown in FIG. 2.

The head 34 is formed integrally with the junction part 32 and in the shape of a cylinder with cutouts 34*a* and 34*b* at two points in the circumferential direction as shown in FIG. 1.

Figure 3:
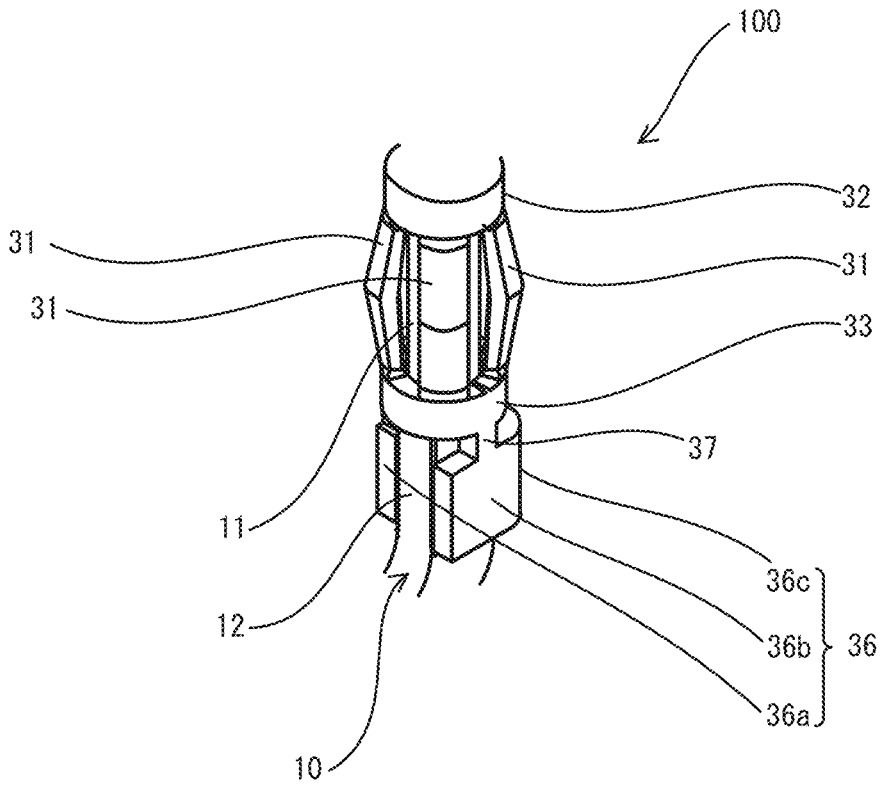
FIG. 3 is a partial perspective view of the press-fit terminal according to the embodiment.

The fixing part 36 has two rectangular plate-like leg pieces 36*a* and 36*b* and a coupling piece 36*c* coupling the two leg pieces 36*a* and 36*b* at their respective one ends in the longitudinal direction. The fixing part 36 is coupled to the junction part 33 via a flexible part 37 as shown in FIG. 3. As shown in FIG. 1, the two leg pieces 36*a* and 36*b* clamp the main piece 12 of the pin part 10 from both sides in the thickness direction. The two leg pieces 36*a* and 36*b* are open before fixed to the main piece 12 of the pin part 10. The two leg pieces 36*a* and 36*b* are fixed to the pin part 10 by thermal caulking in which heating is preceded by closing of the two leg pieces 36*a* and 36*b* with the main piece 12 placed between the two leg pieces 36*a* and 36*b*.

As described above, the fixing part 36 supports the junction part 33 via the flexible part 37 and the junction part 33 supports the multiple contact pieces 31 together. As a result, as the flexible part 37 bends, the junction part 33, multiple contact pieces 31, junction part 32, and head 34 are altogether tilted about the fixing part 36.

For being electrically connected to an electrode 302 of a through-hole via 301 of a circuit substrate 300, as shown by the arrow AR1 in FIG. 1, the press-fit terminal 100 is inserted in the through-hole via 301 of the circuit substrate 300 in which through-hole via 301 is formed. The through-hole via 301 has the electrode 302 formed on the entire inner periphery of the through-hole penetrating the circuit substrate 300. Then, the press-fit terminal 100 is placed in the through-hole via 301 as shown in FIG. 2. At this point, the contact pieces 31 make contact with the electrode 302 of the through-hole via 301, whereby the electrode 302 of the through-hole via 301 and the pin part 10 are electrically connected via the press-fit terminal 100. Moreover, the pin part 10 is fixed on a base (not shown) of the terminal module and electrically connected to a cable (not shown) extended from an external device. Then, as the press-fit terminal 100 is inserted in the through-hole via 301 of the circuit substrate 300, the cable and the wiring of the circuit substrate 300 are electrically connected via the pin part 10, fixing part 36, flexible part 37, junction part 33, and contact pieces 31.

Figure 4:
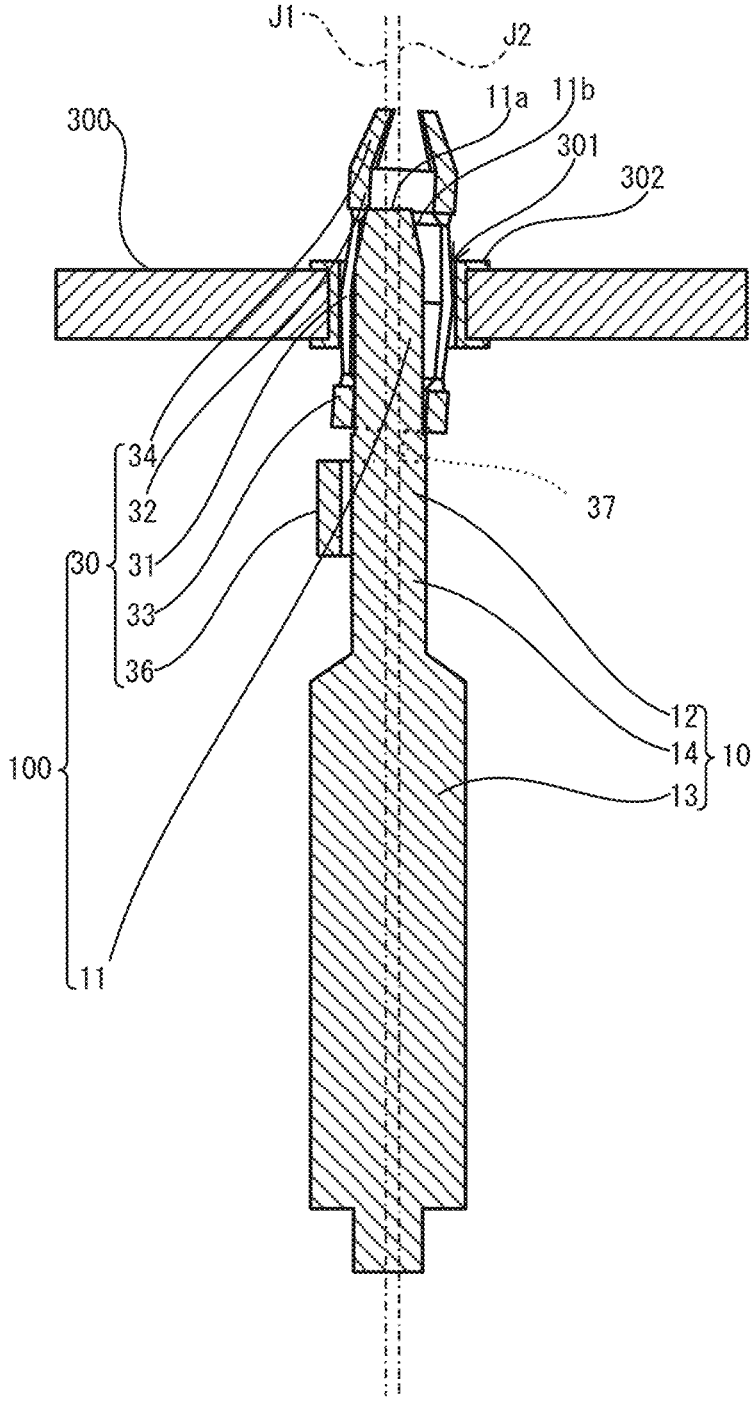
FIG. 4 is a cross-sectional view of the press-fit terminal according to the embodiment.

Moreover, it is assumed that the press-fit terminal 100 is inserted in the through-hole via 301 with the center axis J1 of the terminal body 11 misaligned with the center axis J2 of the through-hole via 301 as shown in FIG. 4. In such a case, the flexible part 37 bends, whereby the contact pieces 31, junction parts 32 and 33, and head 34 are altogether tilted about the fixing part 36 in the direction from the center axis J1 to the center axis J2 while they are placed in the through-hole via 301. At this point, the contact pieces 31 make contact with the electrode 302 of the through-hole via 301, whereby the electrode 302 of the through-hole via 301 and the pin part 10 are electrically connected via the press-fit terminal 100. Furthermore, in this press-fit terminal 100, as shown in FIG. 2, the length L2 of the terminal body 11 is larger than the total length L1 of the contact pieces 31 and junction part 33. As a result, as shown in FIG. 4, as the contact pieces 31, junction parts 32 and 33, and head 34 are altogether tilted to some extent, the leading end 11*b* of the terminal body 11 abuts against the contact pieces 31. Therefore, the contact pieces 31, junction parts 32 and 33, and head 34 are never excessively tilted.

Figure 5:
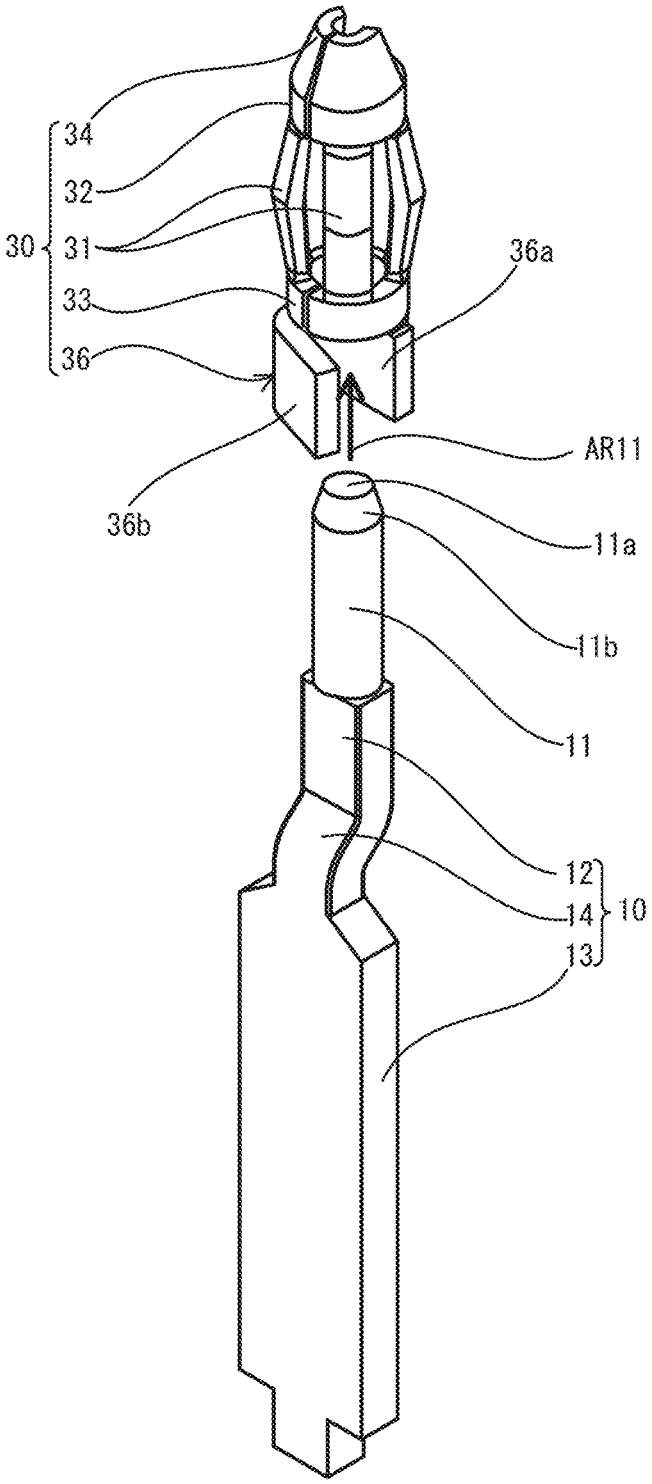
FIG. 5 is a perspective view for explaining the method of producing the press-fit terminal according to the embodiment.
Figure 6:
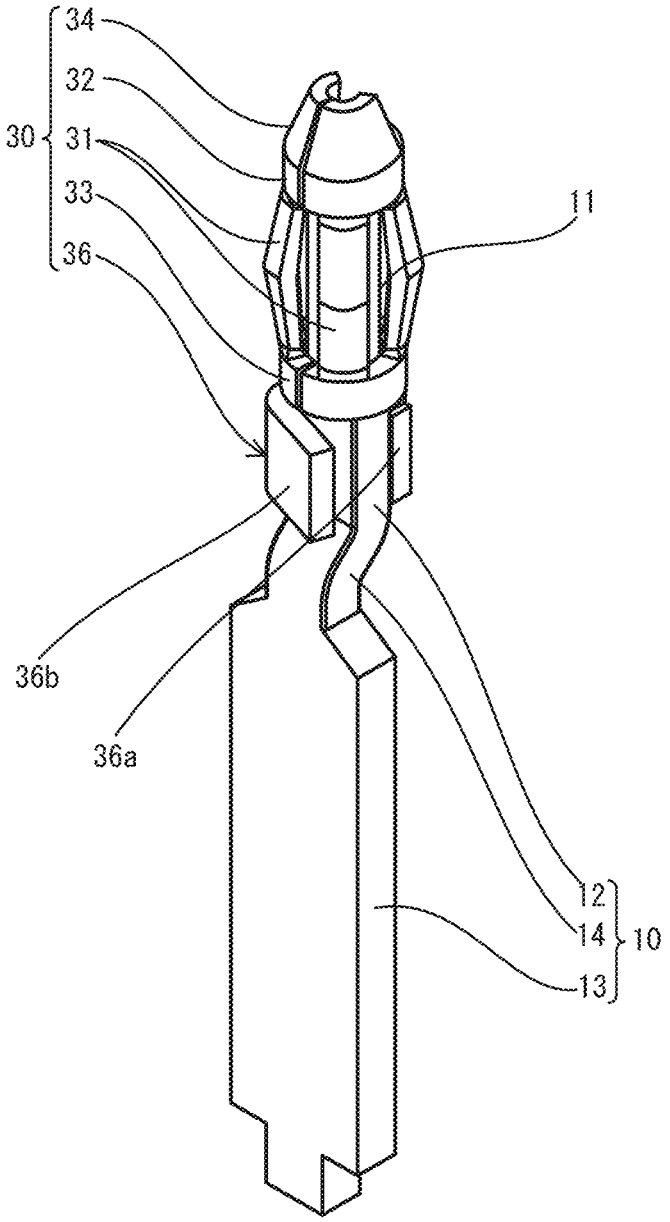
FIG. 6 is a perspective view for explaining the method of producing the press-fit terminal according to the embodiment.

The method of assembling the press-fit terminal 100 according to this embodiment will be described next. Prior to assembling the press-fit terminal 100, the contact member 30 is prepared. The contact member 30 is prepared with the leg pieces 36*a* and 36*b* of the fixing part 36 open. Moreover, the pin part 10 and terminal body 11 are also prepared as an integrated member. In the method of assembling the press-fit terminal 100, first, as shown by the arrow AR11 in FIG. 5, the leading end 11*b* of the terminal body 11 is inserted in the contact member 30. Then, after the terminal body 11 is inserted in the head 34 of the contact member 30, the state as shown in FIG. 6 is obtained.

Subsequently, the main piece 12 of the pin part 10 is clamped between the two leg pieces 36*a* and 36*b* by thermal caulking in which heating is performed with the leg pieces 36*a* and 36*b* of the fixing part 36 closed. Then, the press-fit terminal 100 is completed.

Figure 7A:
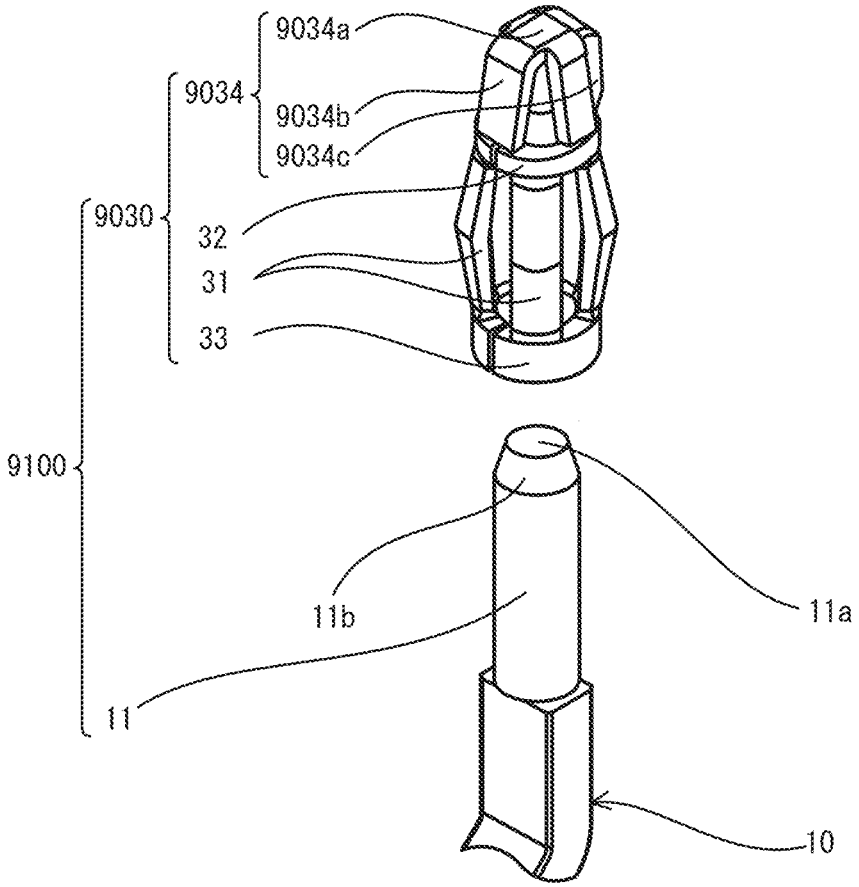
FIG. 7A is an exploded perspective view of a part of the press-fit terminal according to a comparative embodiment.
Figure 7B:
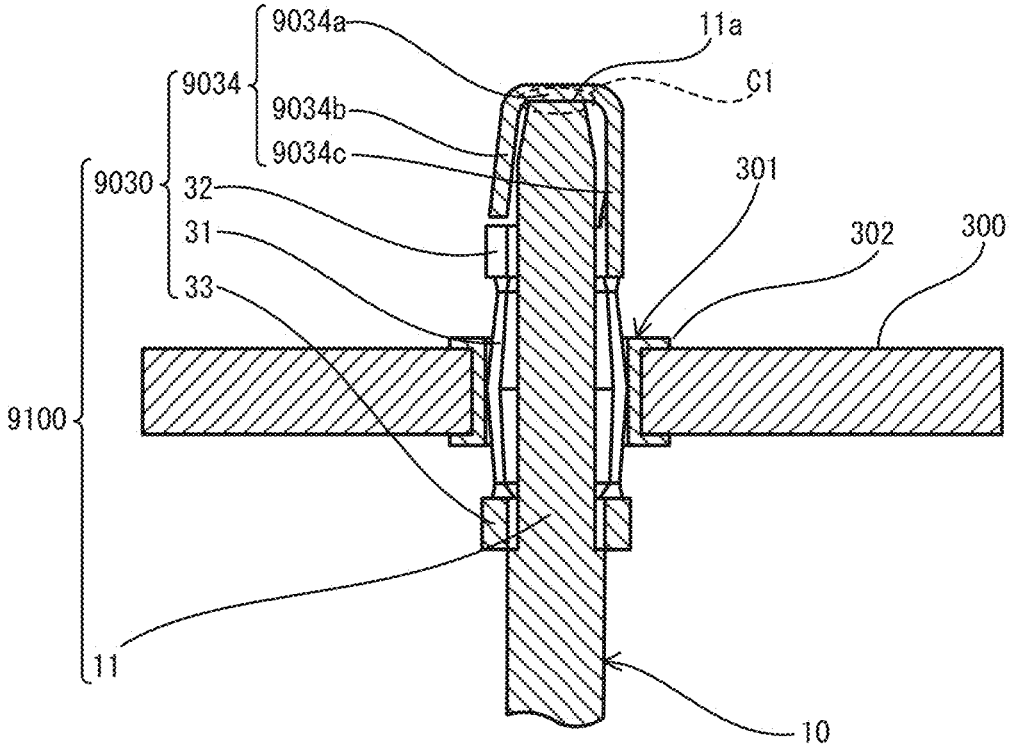
FIG. 7B is a cross-sectional view of the part of the press-fit terminal according to the comparative embodiment.

Characteristics of the press-fit terminal 100 according to this embodiment will be described next in comparison with a comparative embodiment in which the contact pieces 31 and junction parts 32 and 33 can altogether be tilted with respect to the terminal body 11 as in the press-fit terminal 100. A press-fit terminal 9100 according to a comparative embodiment comprises a cover 9034 formed integrally with the junction part 32 as shown in FIGS. 7A and 7B. Here, in FIGS. 7A and 7B, the same components as of the press-fit terminal 100 are referred to by the same reference numbers. The cover 9034 has a flat part 9034*a*, multiple tongues 9034*b* extending from the periphery of the flat part 9034*a* toward the junction part 32, and a coupling part 9034*c* coupling the periphery of the flat part 9034*a* and junction part 32. The flat part 9034*a* is welded to the top surface 11*a* of the terminal body 11 as shown by a portion C1 encircled by a broken line in FIG. 7B. Then, a contact member 9030 is tilted about the flat part 9034*a* welded to the terminal body 11.

The process of assembling the above comparative embodiment includes a step of welding the top surface 11*a*, which is relatively small in area, of the terminal body 11 to the flat part 9034*a*, which requires a high degree of accuracy; therefore, the production requires time and labor.

On the other hand, in the press-fit terminal 100 according to this embodiment, the fixing part 36 can be fixed to the main piece 12 of the pin part 10 simply by thermal caulking in which heating is preceded by closing of the two leg pieces 36*a* and 36*b* with the main piece 12 of the pin part 10 placed between the two leg pieces 36*a* and 36*b* while they are open. Therefore, the press-fit terminal 100 can be produced simply compared to the comparative embodiment.

As described above, with the press-fit terminal 100 according to this embodiment, the flexible part 37 bends, whereby the multiple contact pieces 31, junction parts 32 and 33, and head 34 can altogether be swung about the fixing part 36. As a result, when the press-fit terminal 100 is inserted in the through-hole via 301 with the center axis J2 misaligned with the center axis J1 of the terminal body 11, the multiple contact pieces 31, junction parts 32 and 33, and head 34 are altogether tilted in the direction to cancel the misalignment. Therefore, the pressing force of the multiple contact pieces 31 on the electrode 302 of the through-hole via 301 is made even, whereby a gap is unlikely to occur between the press-fit terminal 100 and through-hole via 301 and thus defective electric connection is unlikely to occur.

Furthermore, the fixing part 36 according to this embodiment has two leg pieces 36*a* and 36*b* clamping the main piece 12 of the pin part 10. Then, the fixing part 36 can be fixed to the main piece 12 of the pin part 10 simply by thermal caulking in which heating is preceded by closing of the two leg pieces 36*a* and 36*b* with the main piece 12 of the pin part 10 placed between the two leg pieces 36*a* and 36*b* while they are open. Therefore, advantageously, the press-fit terminal 100 can relatively simply be assembled.

Moreover, the press-fit terminal 100 according to this embodiment comprises the terminal body 11. Then, the multiple contact pieces 31 and junction parts 32 and 33 are disposed to surround the terminal body 11 around the center axis J1 of the terminal body 11. Then, as the multiple contact pieces 31, junction parts 32 and 33, and head 34 are altogether tiled to some extent, the terminal body 11 abuts against the junction part 32 and some of the contact pieces 31. Therefore, the multiple contact pieces 31, junction parts 32 and 33, and head 34 are never excessively tilted.

Furthermore, the press-fit terminal 100 according to this embodiment comprises the junction part 32 disposed to enclose the terminal body 11 around the center axis J1 of the terminal body 11 and formed integrally with the contact pieces 31. As a result, advantageously, the multiple contact pieces 31 are reinforced by the junction parts 32 and 33 at the ends in the longitudinal direction and are unlikely to be plastically deformed. Moreover, the contact pieces 31 are bent in the center in the longitudinal direction and more away from the terminal body 11 in the center than at the ends in the longitudinal direction. As a result, the multiple contact pieces 31 make contact with the electrode 302 of the through-hole via 301.

Modified Embodiments

Figure 8:
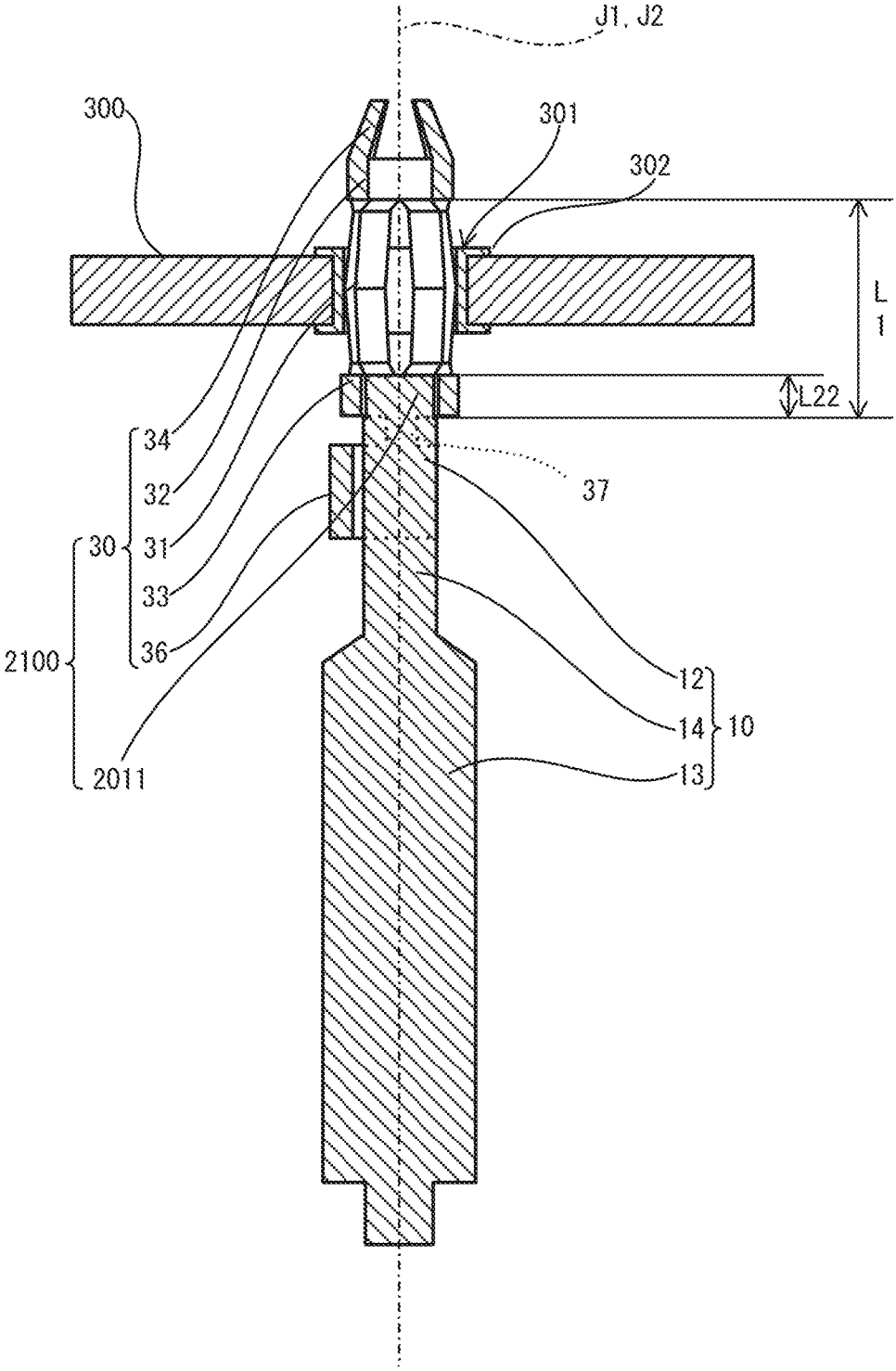
FIG. 8 is a cross-sectional view of the press-fit terminal according to a modified embodiment.
Figure 9:
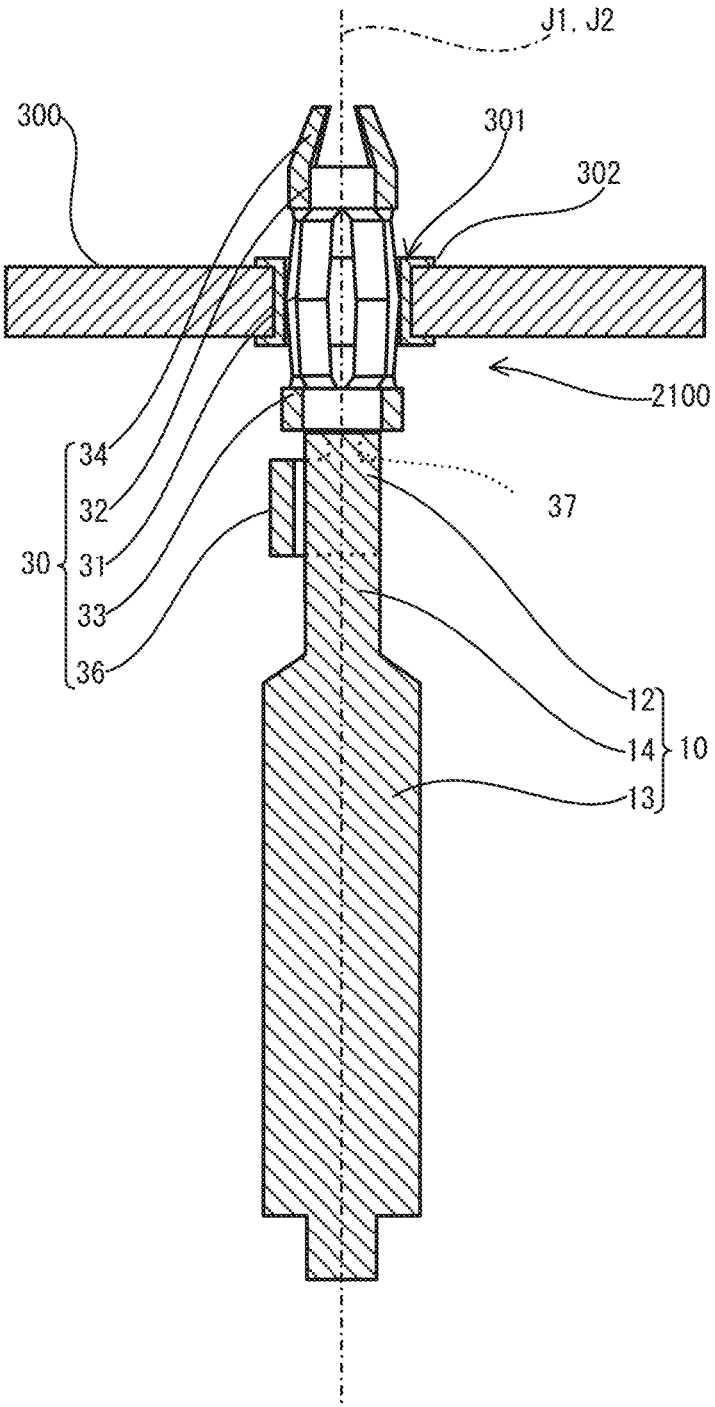
FIG. 9 is a cross-sectional view of the press-fit terminal according to a modified embodiment.

An embodiment of the present disclosure is described above. The present disclosure is not restricted to the structure of the above-described embodiment. For example, as shown in FIG. 8, the length L22 of a terminal body 2011 may be smaller than the length L1 of the contact pieces 31 and junction part 33. Alternatively, as shown in FIG. 9, the terminal body may be eliminated. Here, the junction part 33 is coupled to the fixing part 36 via the flexible part 37.

With the above structure, the flexible part 37 can bend to a larger extent, whereby the multiple contact pieces 31, junction parts 32 and 33, and head 34 can altogether be tilted more. Thus, even when the center axis J1 of the terminal body 2011 and the center axis J2 of the through-hole via 301 are largely misaligned, the multiple contact pieces 31, junction parts 32 and 33, and head 34 can altogether be tilted to cancel the misalignment.

Figure 10:
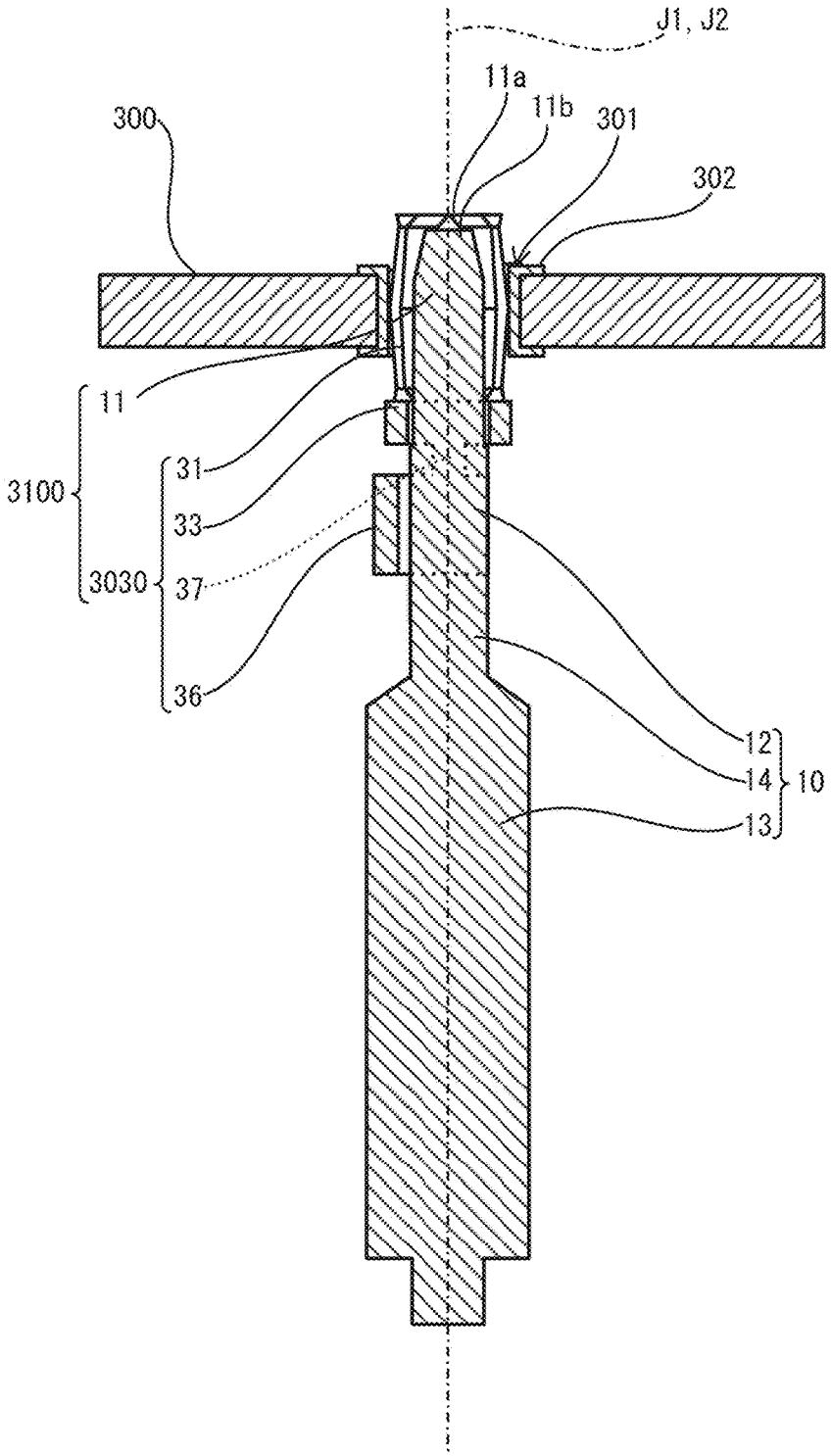
FIG. 10 is a cross-sectional view of the press-fit terminal according to a modified embodiment.

In the above described embodiment, the contact member 30 having the junction part 32 and head 34 is described. However, the contact member is not restricted to the structure having the junction part 32 and head 34. For example, like a press-fit terminal 3100 shown in FIG. 10, the structure comprising a contact member 3030 without the junction part 32 and head 34 can be used. With this structure, the contact member 3030 can be simplified in structure.

In the above-described embodiment, the pin part 10 is clamped by the two leg pieces 36*a* and 36*b* by thermal caulking in which heating is preceded by closing of the two leg pieces 36*a* and 36*b* with the main piece 12 of the pin part 10 placed between the two leg pieces 36*a* and 36*b* while they are open by way of example. However, this is not restrictive and the fixing part 36 may be fixed to the pin part 10 by a method other than thermal caulking such as thermal welding, ultrasonic welding, laser welding, and high frequency welding.

In the press-fit terminal 100 of the above-described embodiment, the flexible part 37 may be formed by a spring. The spring includes a leaf spring and coil spring In the above-described embodiment, the junction parts 32 and 33 are made of the same metal as the contact pieces 31 by way of example. This is not restrictive and, for example, the junction parts 32 and 33 may be made of a non-metal material such as plastic. In such a case, a conductive member such as a metal wire electrically connecting the junction part 33 and flexible part 37 is provided.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

INDUSTRIAL APPLICABILITY

The press-fit terminal of the present disclosure is extensively used in the industrial fields of electric and electronic devices and automobiles as a terminal connected to a through-hole via of a circuit substrate through which a large current flows.

What is claimed is:

1. A press-fit terminal comprising a contact member making contact with an electrode, wherein the contact member comprises:

multiple contact pieces making contact with the electrode;

a first junction part positioned on a basal-end side of the press-fit terminal, the first junction part supporting one end of the multiple contact pieces together;

a second junction part positioned on a leading-end side of the press-fit terminal, the second junction part supporting another end of the multiple contact pieces together; and a fixing part fixed to a pin part and supporting the first junction part via a flexible part, the flexible part is disposed between the first junction part and the fixing part, and the second junction part is directly connected only to the multiple contact pieces.

2. The press-fit terminal according to claim 1, wherein the fixing part comprises two leg pieces clamping the pin part.

3. The press-fit terminal according to claim 1, further comprising:

a terminal body in the shape of a column disposed with the center axis coinciding with a center axis of the pin part, wherein the contact pieces and first junction part are disposed to enclose the terminal body around a center axis of the terminal body.

4. The press-fit terminal according to claim 2, further comprising:

a terminal body in the shape of a column disposed with the center axis coinciding with a center axis of the pin part, wherein the contact pieces and first junction part are disposed to enclose the terminal body around a center axis of the terminal body.

* * * * *